US006089497A

United States Patent [19]

Miyake

[11] Patent Number: 6,089,497

[45] **Date of Patent: *Jul. 18, 2000**

[54] RECORDING DEVICE USING CONTINUOUS PAPER AND METHOD OF FEEDING CONTINUOUS PAPER

[75] Inventor: Hiromasa Miyake, Tokyo, Japan

[73] Assignee: NEC Corporation, Japan

[ * ] Notice: This patent is subject to a terminal disclaimer.

[21] Appl. No.: 09/199,259

[22] Filed: Nov. 25, 1998

Related U.S. Application Data

[63] Continuation of application No. 08/997,961, Dec. 24, 1997.

[30] Foreign Application Priority Data

Dec. 27, 1996 [JP] Japan ..... 8-349720

[51] Int. Cl.[7] ..... B65H 26/00

[52] U.S. Cl. ..... 242/563; 242/562.1

[58] Field of Search ..... 242/562, 562.1, 242/563; 347/215

[56] References Cited

U.S. PATENT DOCUMENTS

| | | | |
|---|---|---|---|
| 4,738,555 | 4/1988 | Nagashima | 347/215 |
| 5,096,134 | 3/1992 | Sakano | 242/562.1 |
| 5,384,584 | 1/1995 | Yoshida et al. | 347/215 |
| 5,511,744 | 4/1996 | Abe | 242/563 |
| 5,555,012 | 9/1996 | Ellson et al. | 347/215 |
| 5,764,264 | 6/1998 | Takanaka | 242/562 |

FOREIGN PATENT DOCUMENTS

| | | | |
|---|---|---|---|
| 0 482 475 A1 | 4/1992 | European Pat. Off. | 242/562 |
| 56-149940 | 11/1981 | Japan | 242/562.1 |
| 57-189954 | 11/1982 | Japan | 242/562 |
| 1-267240 | 10/1989 | Japan | 242/562 |
| 4-190920 | 7/1992 | Japan | 242/563 |

*Primary Examiner*—Donald P. Walsh
*Assistant Examiner*—William A. Rivera
*Attorney, Agent, or Firm*—Ostrolenk, Faber, Gerb & Soffen, LLP

[57] ABSTRACT

A recording device operable with continuous paper in the form of a roll includes a pair of drive rollers for selectively rotating the roll in the forward direction for paying out the paper or in the reverse direction. A controller causes the drive rollers to rotate in the reverse direction in response to a preselected signal. Bar codes representative of serial numbers are printed on one side edge of the paper. While the roll is rotated in the reverse direction, a number identification circuit reads the bar codes 41 and detects the leading edge of the paper on the basis of one bar code positioned at the leading edge and another bar code adjoining a roll position which the leading edge overlies. When the number identification circuit detects the leading edge, the controller switches the direction of rotation of the roll from reverse to forward. Subsequently, a separator is brought into contact with the periphery of the roll in order to separate the paper from the roll and pays out the paper in accordance with the forward rotation.

15 Claims, 6 Drawing Sheets

RECORDING DEVICE USING CONTINUOUS PAPER AND METHOD OF FEEDING CONTINUOUS PAPER

RELATED APPLICATIONS

This is a continuation of application Ser. No. 08/997,961, filed Dec. 24, 1997.

BACKGROUND OF THE INVENTION

1. Field of the Invention

The present invention relates to a recording device of the type using continuous paper and a method of automatically feeding continuous paper. More particularly, the present invention is concerned with a recording device capable of automatically setting continuous paper at a recordable position when the paper is mounted to the device, and a method of feeding continuous paper and automatically setting it in a recordable position.

2. Description of the Prior Art

A thermal printer belonging to a family of recording devices of the type described includes a platen roller and a thermal head facing each other at a recording section. The thermal head has a plurality of heating elements arranged thereon. While continuous paper paid out from a roll is passed through a nip between the platen roller and the thermal head, a current is selectively fed to the heating elements of the head in accordance with an image signal. As a result, an image represented by the image signal is printed on the paper. The prerequisite with this kind of printer is that serial numbers, dates and other information be accurately printed on preselected positions of, e.g., admission tickets sequentially formatted on the continuous paper. To meet this requisite, the thermal printer needs a mechanism for detecting the leading edge of the paper in order to position the paper and then automatically feeding the paper.

FIG. 7 shows a specific configuration of a thermal printer having the above mechanism and taught in Japanese Patent Laid-Open Publication No. 2-293251 published on Dec. 24, 1991. As shown, the printer includes a roll supporting section 11 supporting a roil of continuous paper 10. Both the roll and the paper constituting it will be designated by the same reference numeral 10 hereinafter. A recording section 12 prints an image on the paper 10 paid out from the roll 10. A cutting section 30 cuts off the paper 10 at a preselected length after the printing of the image. An outlet roller pair 18 drives the cut length of the paper, or sheet, out of the printer. The recording section 12 has a platen roller 13 and a thermal head 22 facing and contacting each other. The cutting section 30 has two cutting edges 29 and 31 facing each other. The outlet roller pair 18 is made up of rollers 17 and 19 facing each other.

A pair of drive rollers 15 are mounted on the roll supporting section 11 in the vicinity of the bottom of the section 11. The drive rollers 15 support the roll 10 and cause it to rotate. A sensor 16, a guide 20 and a sensor 14 are arranged between the roll supporting section 11 and the recording section 12. The sensor 16 is responsive to the leading edge 10*a* of the paper 10. The guide 20 is movable toward and away from the periphery of the roll 10. The sensor 14 is responsive to the passage of the leading edge 10*a* of the paper 10. Guide plates 21 and 23 facing each other are positioned between the recording section 12 and the cutting section 30 while guide plates 25 and 27 facing each other are positioned between the cutting section 30 and the outlet roller pair 18.

When the roll 10 is new, it has a mark indicative of the leading edge of the paper 10 printer on the leading edge. When the new roll 10 is rotated counter clockwise, as viewed in FIG. 7, by the drive rollers 15, the sensor 16 senses the above mark of the paper 10. Then, the guide 20 is moved toward the periphery of the roll 10. As a result, the leading edge 10*a* of the paper 10 is separated from the periphery of the roll 10 by the edge of the guide 20.

While the roll 10 is in rotation, the leading edge 10*a* of the paper 10 is conveyed to the nip between the head 22 and the platen roller 13. When the sensor 14 determines that the leading edge 10*a* of the paper 10 has moved away from the sensor 14, the platen roller 13 and outlet roller pair 18 are caused to start rotating while the guide 20 is retracted to its initial position. While the paper 10 is sequentially passed through the nip between the head 22 and the platen roller 13, the head 22 prints an image on the paper 10, as stated earlier. Subsequently, the paper 10 is conveyed to the outlet roller pair 18 via the guides 21 and 23, cutting section 30, and guides 25 and 27. When the paper 10 is driven out by the outlet roller pair 18 by a preselected length, the cutting section 30 cuts off the paper 10.

The problem with the above conventional printer is that it cannot detect the leading edge 10*a* of the paper 10 unless the mark indicative of the leading edge 10*a* exists on the roll 10, e.g., when the roll 10 whose leading edge 10*a* has been cut away during the past recording operation is again mounted to the printer. The printer therefore cannot automatically set such a roll 10 lacking the mark.

To solve the above problem, the leading edge of continuous paper may be detected by an optical implementation, as proposed in the past. An optical implementation, however, is not practicable without resorting to a highly accurate optical sensor. Moreover, should the continuous paper be of the kind including perforations, grooves or folds, the optical sensor would sense them as leading edges and would prevent desired information from being printed at expected positions.

SUMMARY OF THE INVENTION

It is therefore an object of the present invention to provide a recording device and a recording method capable of surely detecting even the leading edge of rolled continuous paper partly used in the past.

It is another object of the present invention to provide a recording device capable of automatically and surely setting continuous paper in a recordable position even when the paper includes perforations, folds, grooves or the like, and a method for the same.

In accordance with the present invention, a recording device for recording information on rolled continuous paper on which serial marks for identification of continuity of the paper are sequentially recorded from the leading edge to the trailing edge includes a rotating mechanism for selectively rotating the paper in the forward direction for paying out the paper or in the reverse direction opposite to the forward direction. A rotation control circuit causes the rotating mechanism to rotate in the reverse direction in response to a preselected signal. A leading edge detecting circuit reads the serial marks of the paper while the paper is rotated in the reverse direction and detects the leading edge of the paper on the basis of one of the serial marks positioned at the leading edge of the paper and another serial mark adjoining a roll position which the leading edge overlies. The rotation control circuit switches, when the leading edge detecting circuit detects the leading edge of the paper, the direction of rotation of the rotating mechanism from reverse to forward. A guiding mechanism separates, after the direction of rotation has been switched by the switching circuit, the leading edge of the paper from the above roll position by contacting the surface of the paper, and pays out the paper in accordance with the rotation of the paper in the forward direction.

Also, in accordance with the present invention, a method of feeding rolled continuous paper has the steps of sequentially recording on the paper serial marks for identification of continuity of the paper from the leading edge to the trailing edge, causing the paper to rotate in the reverse direction opposite to the forward direction in which the paper is paid out, reading the serial marks of the paper while the paper is rotated in the reverse direction, and detecting the leading edge of the paper on the basis of one of the serial marks positioned at the leading edge of the paper and another serial mark adjoining a roll position which the leading edge overlies, switching, when the leading edge of the paper is detected, the direction of rotation of the paper from reverse to forward, and separating, after the direction of rotation has been switched, the leading edge of the paper from the above roll position in contact with the surface of the paper, and paying out the paper in accordance with the rotation of the paper in the forward direction.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
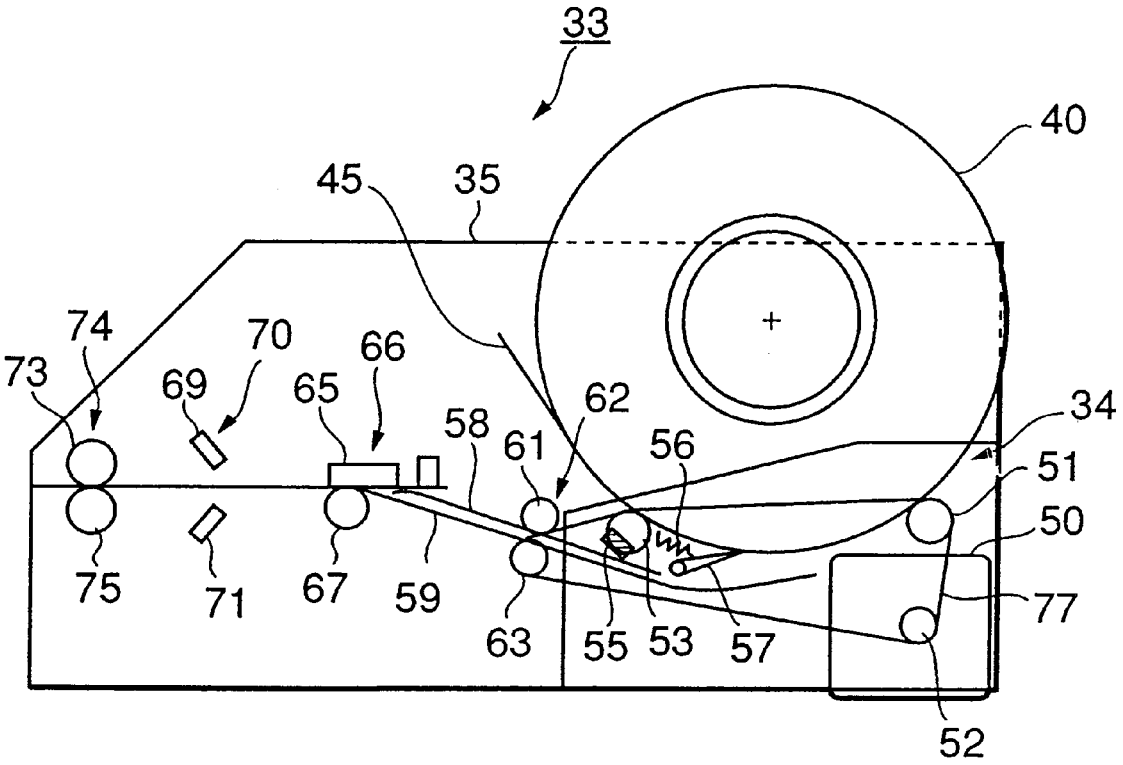
FIG. 1 is a section showing a recording device embodying the present invention in a plane perpendicular to the axis of rolled continuous paper.
Figure 2:
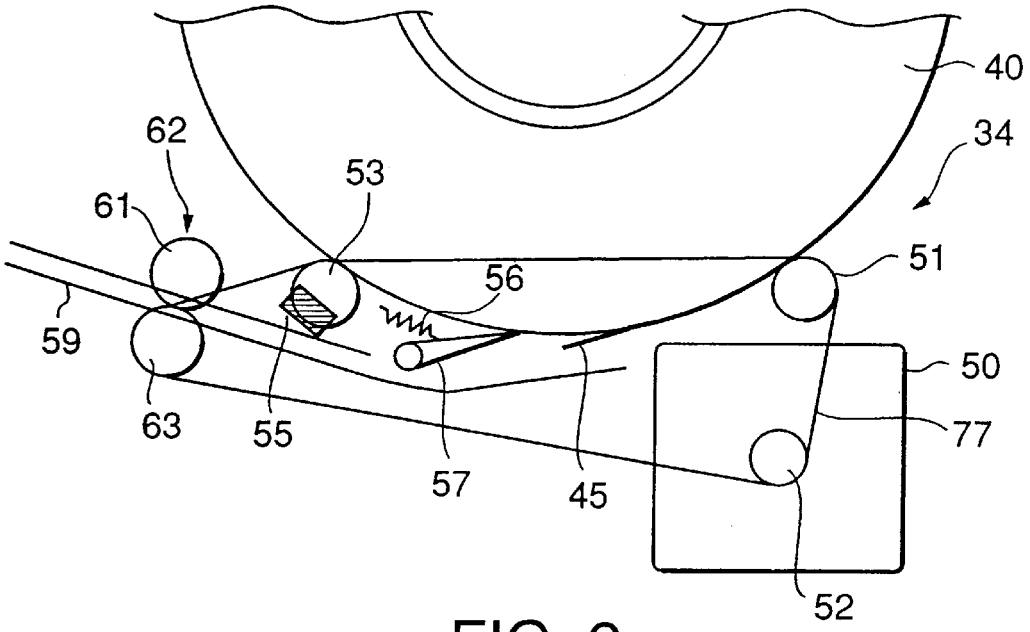
FIG. 2 is a fragmentary enlarged section of the embodiment.

Referring to FIGS. 1 and 2, a recording device embodying the present invention is shown and implemented as a thermal printer using thermosensitive paper by way of example. As shown, the thermal printer, generally 33, includes a printer body 35 having a roll supporting section 34, a recording section 66, a cutting section 70, and an outlet roller pair 74. The roll supporting section 34 supports thermosensitive continuous paper 40 implemented as a roll. Let the roll be also designated by the reference numeral 40 hereinafter. The recording section 66 records an image on the paper 40 paid out from the roll 40. The cutting section 70 cuts off the paper 40 at a preselected length after the printing of the image. The outlet roller pair 74 drives the cut length of the paper, or sheet, out of the printer body 35. The recording section 66 has a platen roller 67 and a thermal head 65 facing and contacting each other. The cutting section 70 has two cutting edges 69 and 71 facing each other. The outlet roller pair 74 is made up of rollers 73 and 75 facing each other.

A pair of drive rollers 51 and 53 are mounted on the roll supporting section 34 in order to cause the roll 40 to rotate. A separator 57 is positioned between the drive rollers 51 and 53 and movable into and out of contact with the periphery of the roll 40. The separator 57 has a pallet-like configuration and is constantly biased toward the roll 40 by a tension coil spring 56. Usually, a solenoid or similar actuator, not shown, maintains the edge of the separator 57 spaced from the roll under the control of a controller 85 (see FIG. 3). When the leading edge of the paper 40 should be separated from the roll 40, the actuator brings the edge of the separator 57 into contact with the roll 10 in response to a command received from the controller 85. A sensor 55 is mounted on one axial end of the drive roller 53 in order to read bar codes 41 (see FIGS. 4A and 4B) repeatedly printed on one side edge portion of the paper 40. Information read by the sensor 55 is sent to the controller 85 via a number identification circuit 81 (see FIG. 3).

Guides 58 and 59 facing each other extend from the separator 57 toward the nip between the platen roller 67 and the head 65 and define a paper transport path. A roller pair 62 for conveying the paper 40 is positioned between the drive roller 53 and the recording section 66 and made up of rollers 61 and 63. Guide plates, not shown, facing each other are positioned between the recording section 66 and the cutting section 70 while other guide plates, not shown, also facing each other are located between the cutting section 70 and the outlet roller pair 74.

A reversible motor 50 is mounted on the bottom of the roll supporting section 34. An endless belt 77 is passed over the rollers 51, 53 and 63 and a pulley 52 affixed to the output shaft of the motor 50. When the motor 50 is driven, it causes the drive rollers 51 and 53 to rotate either in a forward or paper pay-out direction or in a reverse or paper pull-in direction. At the same time, the motor 50 causes the roller 63 to rotate in the same direction as the drive roller 53 while the roller 61 is driven by the roller 63.

Figure 3:
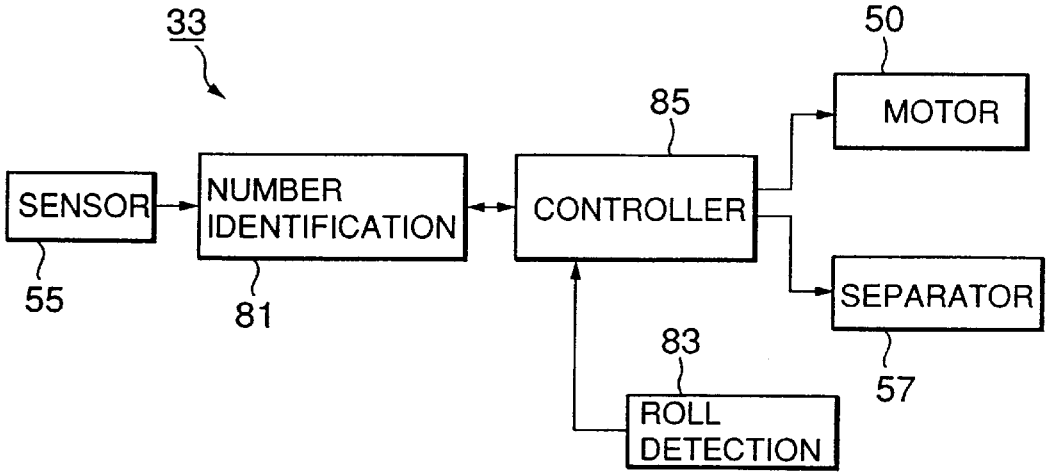
FIG. 3 is a block diagram schematically showing a control system included in the embodiment.

A control system included in the illustrative embodiment will be described with reference to FIG. 3. As shown, the sensor 55 for reading the bar codes 41 is connected to the number identification circuit 81. The number identification circuit 81 determines, based on the output of the sensor 55, whether or not the numbers represented by the bar codes 41 is discontinuous. A roll detection 83 detects the roll 40 when the roll 40 is mounted to the roll supporting section 34. The controller 85 delivers command signals to the motor 50 and separator 57 in accordance with the output of the number identification circuit 81 and that of the roll detection 83. In this embodiment, the identification circuit 81 and the controller 85 is a leading edge detecting circuit and the controller 85 is a rotation control circuit for causing the motor 50 to rotate in the forward and reverse directions.

When the roll 40 is mounted to the roll supporting section 34, as determined by the roll detection 83, the controller 85 causes the motor 50 to rotate the roll 40 in the reverse direction and causes the number identification circuit 81 to start operating. When the number identification circuit 81 detects discontinuity between the consecutive numbers represented by the bar codes 4l, the controller 85 switches the motor 50 in order to cause the roll 40 to rotate in the forward direction. At the same time, the controller 85 brings the edge of the separator 57 into contact with the periphery of the roll 40.

Figure 4A:
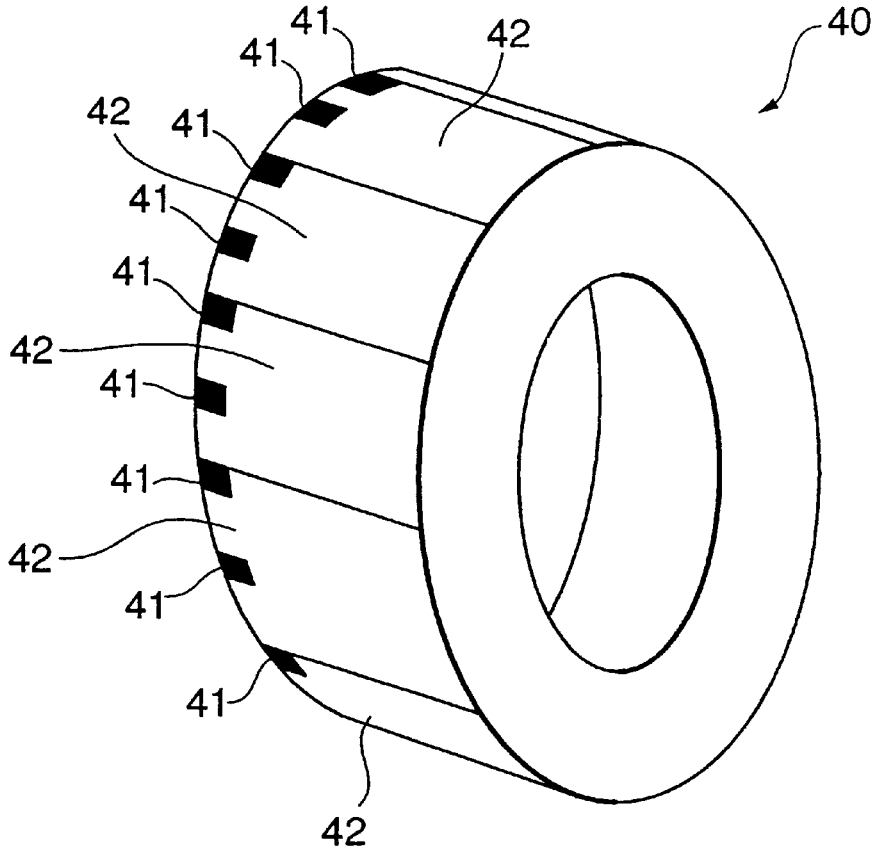
FIG. 4A is a perspective view showing the roll included in the embodiment.
Figure 4B:
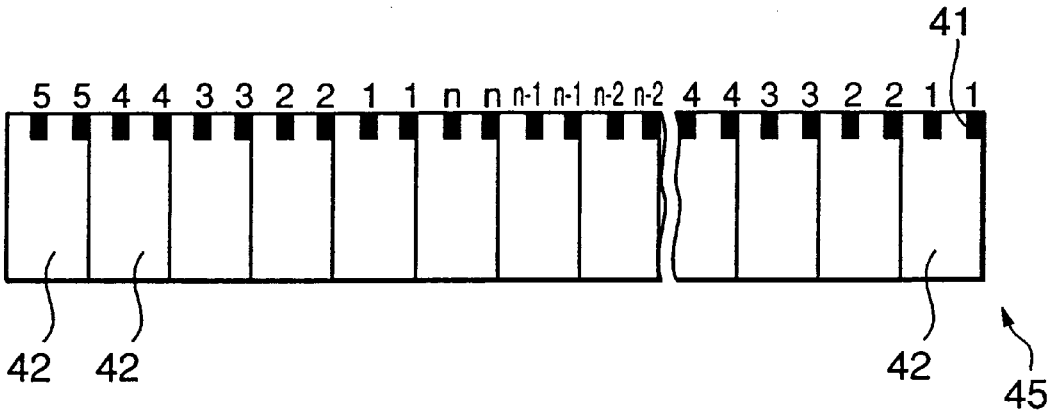
FIG. 4B is a fragmentary plan view showing the continuous paper constituting the roll of FIG. 4A.
Figure 5:
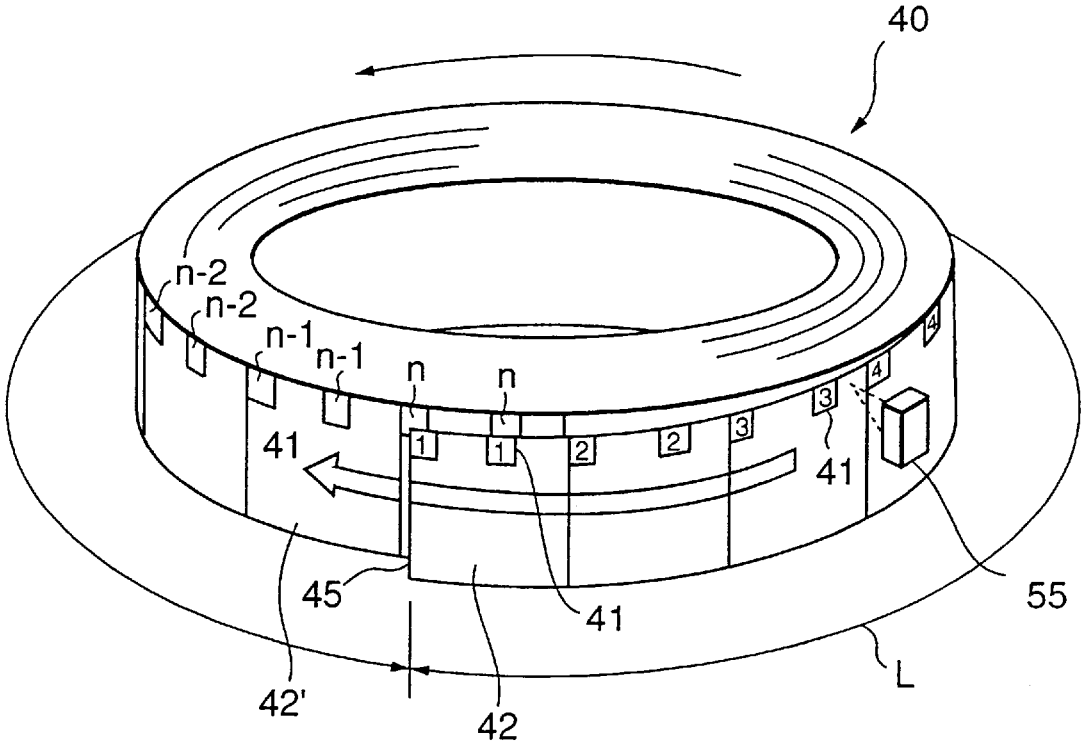
FIG. 5 is a perspective view showing a specific implementation for detecting the leading edge of the paper.

Referring to FIGS. 4A, 43 and 5, marks printed on the continuous paper 40 and a specific implementation for detecting the leading edge of the paper 40 will be described hereinafter. As shown in FIG. 4B, the paper 40 is implemented as a chain of admission tickets 42 by way of example. The paper 40 is rolled up, as shown in FIG. 4A. Marks representative of a group of numbers are repeatedly printed on the paper 40 from the leading edge to the trailing edge of the paper 40, so that the leading edge 45 of the paper 40 can be detected. In practice, the marks are implemented as the bar codes 41 corresponding to numerals. It is to be noted that the bar codes 41 are shown in FIGS. 4A and 4B in a simplified form and different from actual ones.

As shown in FIG. 4B, a group of serial numbers "1" to "n", i.e., n different kinds of positive integers are repeatedly printed on the paper 40 from the leading edge 45 to the trailing edge as the bar codes 41. Specifically, the consecutive bar codes 41 are representative of numerals "1, 1, 2, 2, 3, 3, 4, 4, . . . , n−1, n−1, n, n, 1, 1, 2, 2 . . . ." As shown in FIG. 5, assume that the sensor 55 reads the bar codes 41 while the roll 40 is rotated counterclockwise, as viewed in FIG. 5. Then, the above sequence of numerals are usually identified in the descending order. However, the numeral represented by the bar code 41 of the ticket 42 positioned at the leading edge 45 of the paper 10, e.g., "1" and the numeral represented by the bar code 41 of the ticket 42' adjoining the roll position which the leading edge 45 overlies, e.g., "n−1" are not continuous. By detecting such discontinuity, it is possible to surely detect the leading edge 45 of the paper 40.

In the specific condition shown in FIG. 5, while the roll 40 is rotated counterclockwise, the sensor 55 sequentially reads the numerals in the order of "3, 3, 2, 2, 1, 1, n−1, n−1, n−2, n−2, . . . " That is, when the leading edge 45 of the paper 10 moves away from the sensor 55, the sensor 55 does not read "n" but reads "n−1" after "1, 1". As a result, the leading edge 45 is detected on the basis of discontinuity between the numerals "1" and "n−1".

Assume that the roll 40 has a large diameter and therefore a large circumferential length L. Then, it may occur that the sensor 55 reads a serial number after the leading edge 45 has moved away from the sensor 55. In light of this, in the illustrative embodiment, the circumferential length L is so selected as to satisfy a relation:

$$L<(n-1)\times 2P$$

where P is the pitch of the sequential marks.

Figure 6:
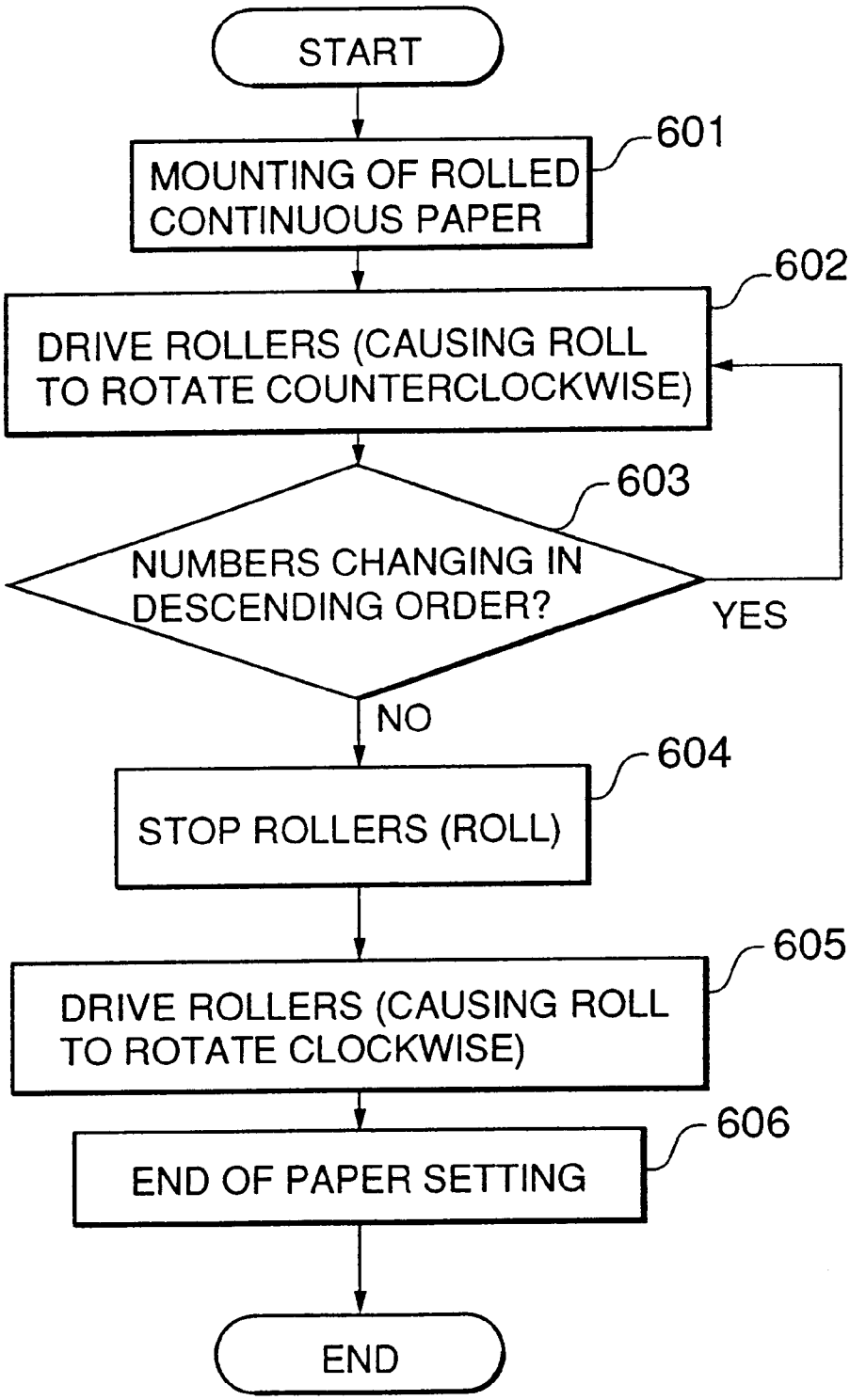
FIG. 6 is a flowchart demonstrating a specific operation of the embodiment.
Figure 7:
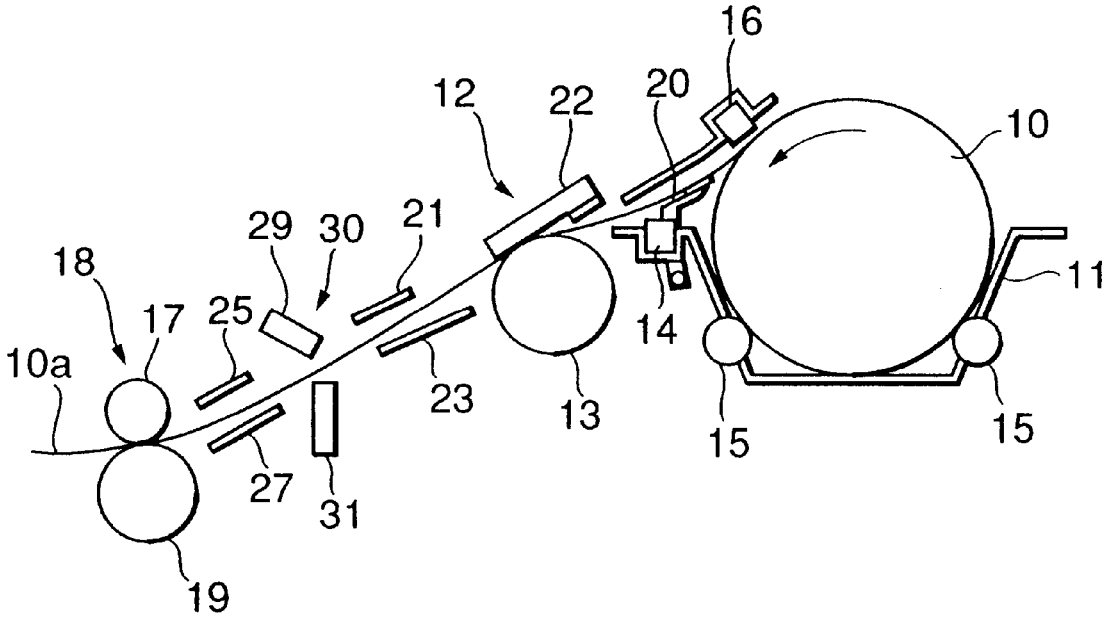
FIG. 7 (PRIOR ART)
FIG. 7 is a fragmentary section showing a conventional thermal printer in a plane perpendicular to the axis of rolled continuous paper.

Reference will be made to FIG. 6 for describing the operation of the printer 33. As shown, when a new roll 40 is mounted to the roll supporting section 34, the roll detection 83 (FIG. 3) detects the roll 40 and sends its output to the controller 85. In response, the controller 85 determines that the new roll 40 has been mounted to the printer 33 (step 601). The controller 85 sends a reverse command to the motor 50 so as to cause it to rotate in the reverse direction. The motor 50, in turn, rotates the drive rollers 51 and 53 clockwise, as viewed in FIG. 2. Consequently, the roll 40 is rotated in the reverse direction, i.e., counterclockwise, as viewed in FIGS. 2 and 5 (step 602).

Subsequently, the controller 85 causes the number identification circuit 81 to start operating and delivering the output of the sensor 55 to the controller 85. The controller 85 determines, based on the output of the sensor 55, whether or not the numbers represented by the bar codes 41 are changing in the descending order (step 603). If the answer of the step 603 is positive (YES), then the controller 85 returns to the step S602 and continues the reverse rotation of the motor 50, i.e., the counterclockwise rotation of the roll 40.

If the answer of the step 603 is negative (NO), meaning that the numbers have not changed in the descending order, then the controller 85 sends a stop command to the motor 50 on the elapse of a preselected period of time. This preselected period of time refers to an interval between the time when the sensor 55 senses the leading edge 45 and the time when the leading edge 45 moves over the separator 57 to the upstream side in the direction of paper feed. Alternatively, the controller 85 may cause the roll 40 or the drive rollers 51 and 53 to rotate a preselected angle after the sensor 55 has sensed the leading edge 45.

The roll 40 is therefore brought to a stop when its leading edge 45 reaches a position slightly past the separator 57 in the counterclockwise direction (step 604). Subsequently, the controller 85 sends a forward command to the motor 50 and thereby causes it to rotate in the forward direction. As a result, the motor 50 causes the roll 40 to rotate clockwise, i.e., in the direction of paper feed (step 605). At the same time, the controller 85 sends a switch command to the actuating mechanism for actuating the separator 57. In response, the actuating mechanism brings the edge of the separator 57 into contact with the periphery of the roll 40.

While the roll 40 is rotated in the direction of paper feed, the separator 57 sequentially separates the leading edge 45 of the paper 10 from the roll 40. The leading edge 45 is conveyed by the roller pair 62 to the path between the guides 61 and 63. As soon as the leading edge 45 reaches the nip between the platen roller 65 and the head 67 past the nip of the roller pair 62, the controller 85 sends a stop command to the motor 50 so as to stop its rotation. As a result, the forward rotation of the roll 40 is stopped with the paper 40 set in a recordable position (step 606).

At the time of printing, the roller pair 62 and outlet roller pair 74 are caused to rotate in the forward direction so as to convey the paper 40. At the same time, the heating elements of the head 65 are selectively energized in accordance with an image signal, forming an image on the paper 40. For example, the head 65 prints, e.g., dates, serial numbers and other necessary information on the chain of tickets 42 implemented by the paper 40. After such information have been printed on the paper 40, the cutting section 70 is operated in order to cut off the paper 40 at an adequate position. The cut length of the paper 40 is driven out of the printer 33 by the outlet roller pair 74.

As stated above, the printer 33 is operable with the continuous paper 40 in the form of a roll. The bar codes 41 representative of a group of serial numbers implemented by positive integers "1" through "n" are repeatedly printed on one side edge of the paper 40. The number identification circuit 81 identifies the leading edge 45 of the paper 40. Therefore, even when the roll 40 partly used in the past is again mounted to the printer 33, the printer 33 is capable of surely detecting the leading edge 45. In addition, the printer 33 is capable of surely distinguishing the leading edge 45 from perforations, folds or grooves which may be formed in the paper 40.

While the marks for the identification of the serial numbers "1" through "n" have been shown and described as being implemented as the bar codes 41, the bar codes 41 may, of course, be replaced with any other suitable form of marks, e.g., marks each having a particular design representative of a numerical value. If desired, the paper 40 may be implemented as plain paper in place of thermosensitive paper, in which case the thermal head 65 will be replaced with an ink jet head or a stamp.

In summary, it will be seen that the present invention provides a recording device capable of surely detecting the leading edge of rolled continuous paper even when the paper has been partly used in the past. The recording device is therefore capable of automatically setting the paper in a recordable position.

As used herein, the term "serial marks" means indicia representative of numbers, letters and/or other ordered relationships. For example, the printed number "2" is indicia representative of the number two. Similarly, a bar code can be indicia representative of the number two. "Sequential" or "sequentially" means that the serial marks are in a predesignated sequential order. Such order will normally be a classical sequential order (e.g., 1, 2, 3, 4, . . . ) However, any sequential order can be designated (for example, the numbers 1, 3, 5, 7, 9, . . . , the numbers 3, 7, 1, 11, 15, 2, . . . or the symbols !, @, #, $, %, ^, &, *, . . . could be designated as being sequential). Serial marks which repeat but are otherwise in the designated sequential in order (e.g., 1, 1, 2, 2, 3, 3, or A,A,A, C,C,C, F,F,F) are also considered to be in the designated sequential in order.

Various modifications will become possible for those skilled in the art after receiving the teachings of the present disclosure without departing from the scope thereof.

What is claimed is:

1. Apparatus for determining the location of a leading edge of a an elongated, flat strip of paper rolled up into a helix to form a generally cylindrical body, said strip of paper having a principal surface having serial marks recorded thereon in a designated sequential order between a leading edge of said paper and a trailing edge thereof, said generally cylindrical body having an outer surface defined by a portion of said principal surface containing at least two of said serial marks which are not in said designated sequential order and facing radially outwardly with respect to a central axis of said generally cylindrical body, said leading edge of said paper being located on said outer surface of said generally cylindrical body and abutting a portion of said principal surface which is remote from said leading edge as measured along said principal surface in a downstream direction extending from said leading edge toward said trailing edge, said apparatus comprising:

a detector which detects said serial marks as said outer surface is rotated past said detector;

an analyzer for determining the location of said leading edge of said paper by determining that two adjacent serial marks located on the outside of said generally cylindrical body and detected by said detector are not in said designated sequential order.

2. Apparatus according to claim 1, wherein a portion of said principal surface immediately downstream from said leading edge has a first serial mark thereon and said portion of said principal surface remote from said leading edge has a second serial mark thereon, said first and second serial marks not being in said designated sequential order.

3. Apparatus according to claim 2, wherein said serial marks are indicative of numbers.

4. Apparatus according to claim 2, further including said roll of paper.

5. Apparatus according to claim 1, wherein said serial marks are indicative of numbers.

6. Apparatus according to claim 1, further including a sheet separator which separates said leading edge from said roll of paper after said analyzer determines said location of said leading edge.

7. Apparatus according to claim 6, further including means for rotating said roll of paper in a payout direction and an opposite pull-in direction around an axis of said generally cylindrical body, said rotating means first rotating said roll in said pull-in direction so that said analyzer can determine the position of said leading edge and then rotating said roll in said payout direction when said sheet separator separates said leading edge.

8. Apparatus according to claim 6, further including said roll of paper.

9. Apparatus according to claim 1, further including said roll of paper.

10. A method for determining the location of a leading edge of a an elongated, flat strip of paper rolled up into a helix to form a generally cylindrical shape, said strip of paper having a principal surface having serial marks recorded thereon in a designated sequential order between a leading edge of said paper and a trailing edge thereof, said generally cylindrical shape having an outer surface defined by a portion of said principal surface containing at least two of said serial marks which are not in said designated sequential order and facing radially outwardly with respect to a central axis of said generally cylindrical body, said leading edge of said paper being located on said outer surface of said generally cylindrical body and abutting a portion of said principal surface which is remote from said leading edge as measured along said principal surface in a downstream direction extending from said leading edge toward said trailing edge, said method comprising the steps of:

detecting said sequential serial marks as said outer surface is rotated past said detector;

determining the location of said leading edge of said paper by determining that two adjacent serial marks located on the outside of said generally cylindrical body and detected by said detector are not in said designated sequential order.

11. A method according to claim 10, wherein a portion of said principal surface immediately downstream from said leading edge has a first serial mark thereon and said portion of said principal surface remote from said leading edge has a second serial mark thereon, said first and second serial marks not being in said designated sequential order.

12. A method according to claim 11, wherein said serial marks are indicative of numbers and are formed on said principal surface in a sequential order.

13. A method according to claim 10, wherein said serial marks are indicative of numbers and are formed on said principal surface in a sequential order.

14. A method according to claim 10, further including the step of separating said leading edge from said roll of paper after determining said location of said leading edge.

15. A method according to claim 14, further including the steps of rotating said roll of paper in a pull-in direction when said analyzer determines the position of said leading edge and rotating said roll in a payout direction when said leading edge is separated from said outer surface of said generally cylindrical body.

* * * * *